US006272876B1

(12) United States Patent
Roberts et al.

(10) Patent No.: US 6,272,876 B1
(45) Date of Patent: Aug. 14, 2001

(54) DISPLAY FREEZER HAVING EVAPORATOR UNIT

(75) Inventors: Carl C. Roberts, Oconomowoc, WI (US); Keith R. Mickelson, Maple Grove, MN (US)

(73) Assignee: Zero Zone, Inc., North Prairie, WI (US)

( * ) Notice: Subject to any disclaimer, the term of this patent is extended or adjusted under 35 U.S.C. 154(b) by 0 days.

(21) Appl. No.: 09/533,408

(22) Filed: Mar. 22, 2000

(51) Int. Cl.[7] ..... A47F 3/04
(52) U.S. Cl. ..... 62/255; 62/256; 454/193
(58) Field of Search ..... 62/246, 255, 256, 62/407, 515, 524, 525; 165/122; 454/193

(56) References Cited

U.S. PATENT DOCUMENTS

| | | | |
|---|---|---|---|
| Re. 20,016 | | 6/1936 | Hopkins . |
| 1,773,249 | | 8/1930 | Yeager . |
| 3,249,156 | | 5/1966 | McGrew . |
| 3,645,330 | | 2/1972 | Albright et al. . |
| 3,780,799 | | 12/1973 | Pasternak . |
| 3,796,258 | | 3/1974 | Malhotra et al. . |
| 4,369,632 | * | 1/1983 | Abraham ..... 62/256 |
| 4,586,563 | | 5/1986 | Dubrovsky et al. . |
| 4,775,007 | | 10/1988 | Sakuma et al. . |
| 4,860,822 | | 8/1989 | Sacks . |
| 5,000,258 | | 3/1991 | Negishi . |
| 5,056,594 | | 10/1991 | Kraay . |
| 5,111,876 | | 5/1992 | Nash . |
| 5,168,923 | | 12/1992 | Sacks . |
| 5,347,827 | | 9/1994 | Rudick et al. . |
| 5,983,998 | * | 11/1999 | Kim ..... 165/122 |

* cited by examiner

*Primary Examiner*—William E. Tapolcal
*Assistant Examiner*—Mohammad M. Ali
(74) *Attorney, Agent, or Firm*—Michael Best & Friedrich LLP

(57) ABSTRACT

A display freezer including a display case defining an interior space; an evaporator cover assembly located in the interior space and separating the interior space into a display portion and an evaporator portion, a fan plenum having therein an inlet communicating with the display portion of the interior space and an outlet spaced from the inlet and communicating between the evaporator portion and the display portion of the interior space; a fan operable to create a flow of air through the inlet and the outlet; a first baffle located adjacent the inlet and a second baffle and defining a serpentine path extending from the inlet for conducting the flow of air in the evaporator portion and an evaporator coil assembly located in the evaporator portion between the inlet and the outlet.

42 Claims, 4 Drawing Sheets

DISPLAY FREEZER HAVING EVAPORATOR UNIT

FIELD OF THE INVENTION

The invention relates to display freezers, and more particularly to evaporator units for display freezers.

BACKGROUND OF THE INVENTION

Display freezers are commonly used in retail outlets such as supermarkets, restaurants, convenience stores and other establishment that sell frozen or refrigerated foods. The display freezers typically include a display case having shelves for displaying various products such as food. Glass doors allow the consumer to survey the selection of products without having to open each of the doors. When a selection is made, the consumer can quickly open the appropriate door, remove the desired item and close the door. Display freezers also include an evaporator unit that keeps the interior of the display case cold. Often the evaporator unit is housed beneath the display case. Air circulates from the interior of the display case, through the evaporator unit, and back into the display case.

One objective in designing display freezers is to maximize the available volume of the interior display case, thereby maximizing the food storage capacity. A constraint on achieving this objective is the footprint, i.e., the width and depth of the display freezer, is often limited by the size constraints of the retail outlet in which the freezer will be placed. Similarly, the useable height of a display freezer's interior is limited both by the available retail space and by the height of the average consumer.

SUMMARY OF THE INVENTION

One approach to maximizing the volume of the display area is to reduce the size of the remaining components of the display freezer, including the evaporator. This approach is also constrained by operational requirements of the evaporator. Specifically, the evaporator must have sufficient cooling capacity not only to maintain below-freezing temperatures, but also to "pull down" the display temperature from relatively high temperatures to a steady below-freezing temperature. Such pull down capacity is needed, for example, when the freezer is restocked or turned off for maintenance.

Consequently, the structural size of the evaporator should be as small as possible while retaining sufficient cooling capacity available to cool the display case.

The present invention provides a display freezer having a relatively small, highly efficient, evaporator unit. The reduced size of the evaporator unit increases the available space for the display case. In addition, the improved efficiency of the evaporator unit provides sufficient cooling capacity required to properly maintain the larger display case. More specifically, the evaporator unit of the present invention includes a unique configuration of air flow baffles and refrigerant coils to optimize heat transfer.

In one embodiment, the invention provides a display freezer including a display case defining an interior space and an evaporator cover assembly located in the interior space and separating the interior space into a display portion and an evaporator portion. The display freezer also includes a fan plenum having therein an inlet communicating with the display portion of the interior space and an outlet spaced from the inlet and communicating between the evaporator portion and the display portion of the interior space. The display freezer also includes a fan operable to create a flow of air through the inlet and the outlet, a first baffle located adjacent the inlet, and a second baffle defining a serpentine path extending from the inlet for conducting the flow of air in the evaporator portion. The display freezer also includes an evaporator coil assembly located in the evaporator portion between the inlet and the outlet and including a plurality of sheet-like fins extending in the direction of the air flow and having a sinusoidal cross section in a plane perpendicular to fins, and a plurality of evaporator coil circuits extending through the plurality of fins, the evaporator coil circuits being adapted to conduct therethrough a supply of refrigerant.

Other features and advantages of the invention will become apparent to those skilled in the art upon review of the following detailed description, claims, and drawings.

Figure 1:
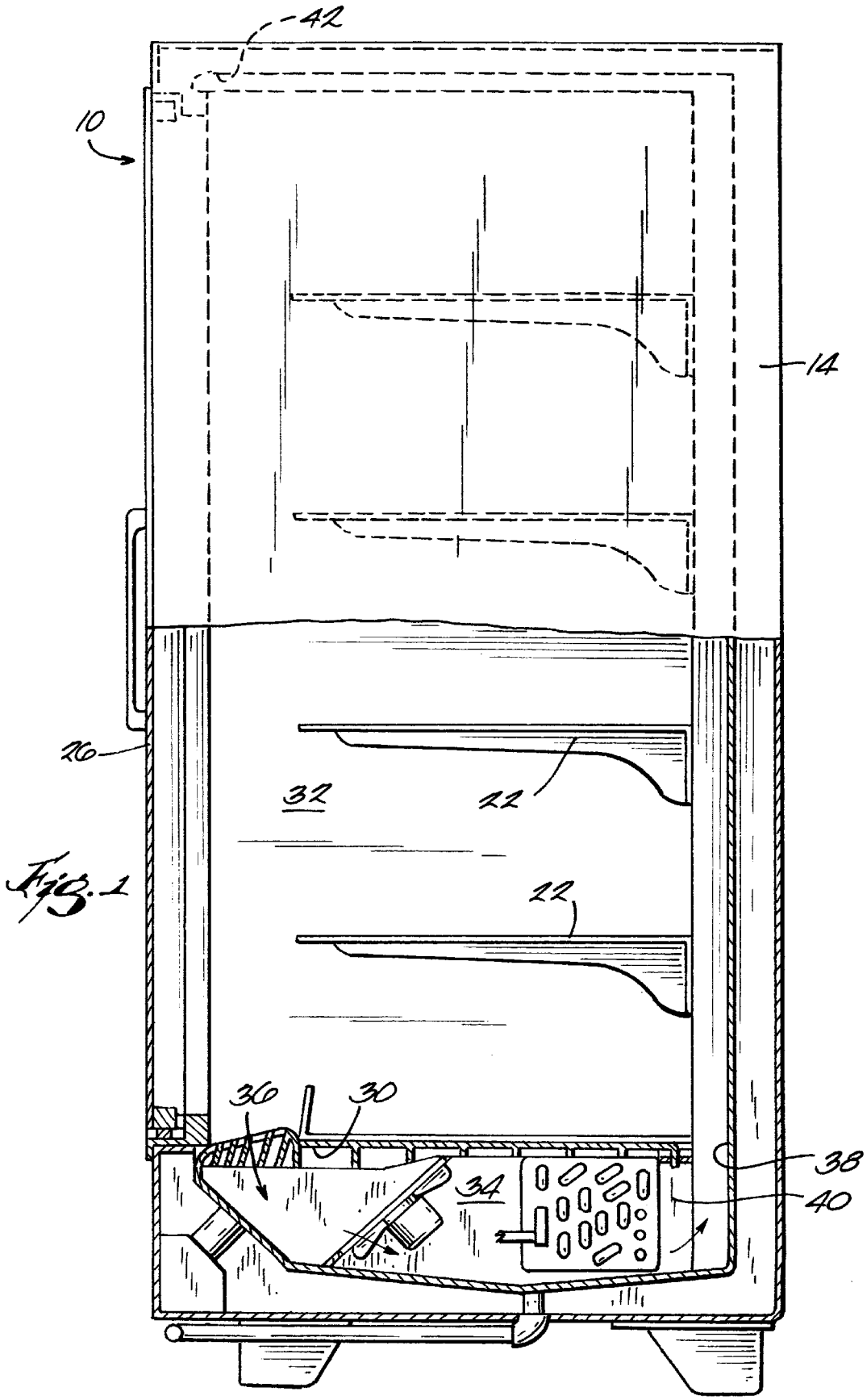
FIG. 1 is a side view, partially in section, of a display freezer embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter.

DETAILED DESCRIPTION OF THE PREFERRED EMBODIMENT

The drawings illustrate a display freezer 10 embodying the invention. The freezer 10 includes a cabinet 14 defining an interior space 18 and shelves 22 mounted on the cabinet 14 in the interior space 18. A door 26 mounted on the cabinet 14 affords access to the interior 18 of the cabinet 14.

The freezer 10 also includes an evaporator cover assembly 30 extending across the interior 18 of the cabinet 14 and dividing the interior 18 of the cabinet 14 into an upper display portion 32 wherein the shelves 22 are located, and a lower portion 34. In order to afford the passage of an air flow from the display portion 32 into the lower portion 34, the cover assembly 30 includes an air flow inlet 36 communicating between the upper and lower portions 32, 34 of the interior 18. The air flow inlet 36 is located adjacent the front wall of the cabinet 14 and below the door 26.

In order to recirculate air from the lower portion 34 to the display portion 32 of the interior 18, the cabinet 14 also includes a recirculation passage 38 located within the rear wall of the cabinet 14 and extending between the lower portion 34 and the upper portion 32. The recirculation passage 38 communicates between a recirculation inlet 40 located in the lower portion 34 adjacent the rear wall and a recirculation outlet 42 located in the display portion 32 adjacent the upper edge of the door 26.

Figure 2:
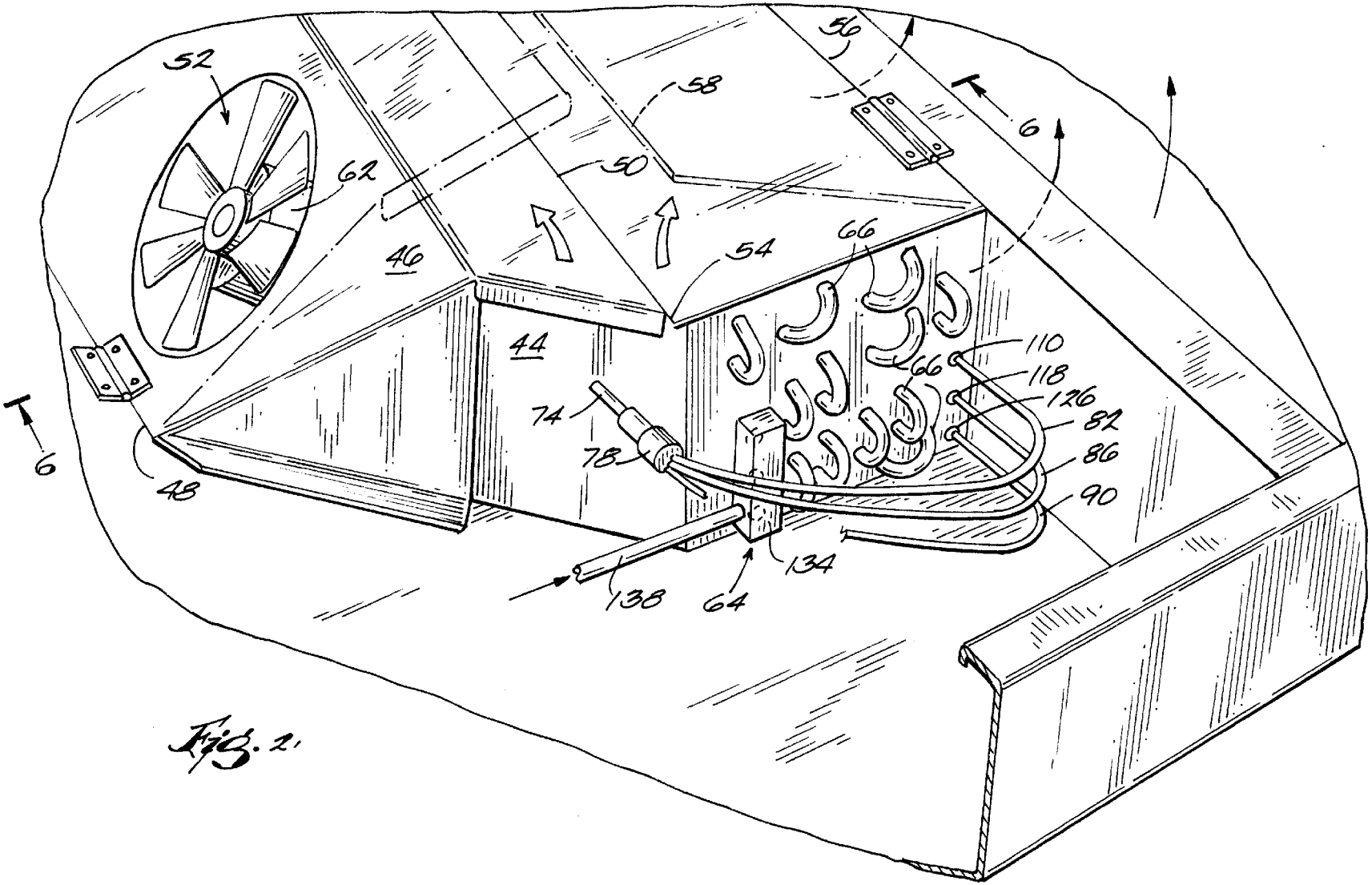
FIG. 2 is an enlarged perspective view of a portion of the display freezer shown in FIG. 1.
Figure 3:
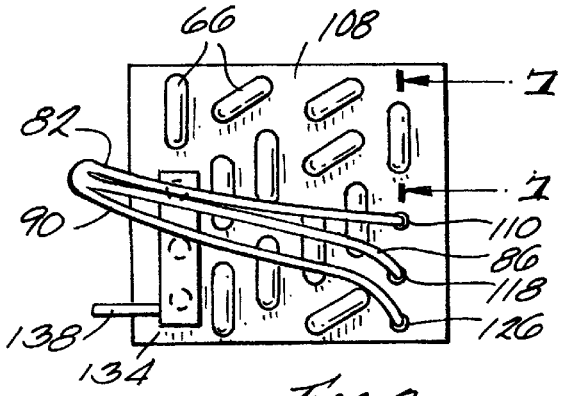
FIG. 3 is an end view of the evaporator shown in FIG. 2.
Figure 4:
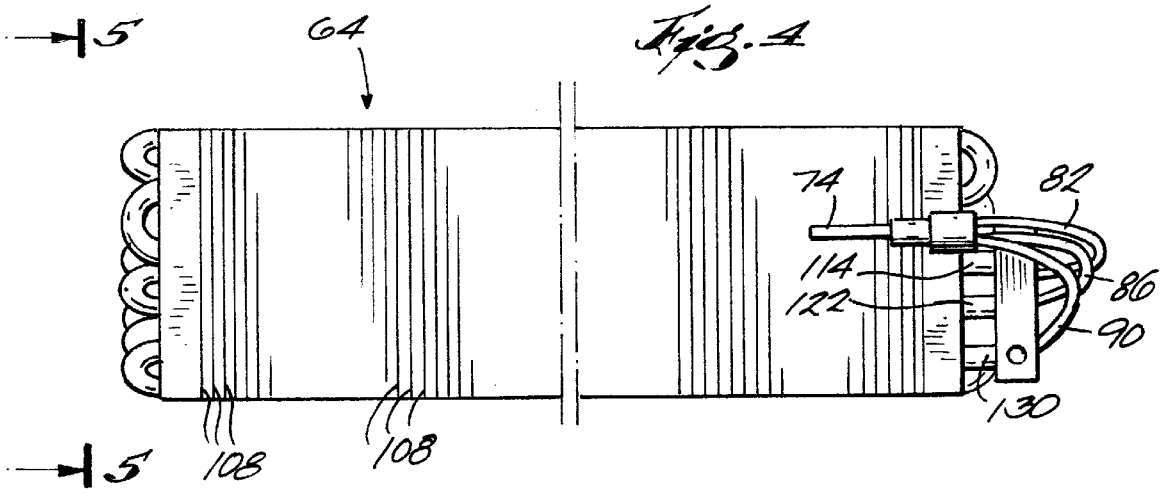
FIG. 4 is a side elevational view of the evaporator shown in FIG. 3.
Figure 5:
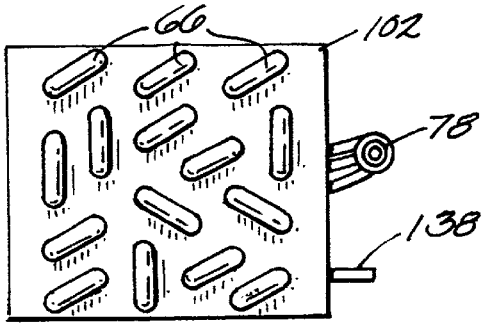
FIG. 5 is a view taken along line 5—5 in FIG. 4.

The freezer 10 also includes a fan plenum 44 located in the lower portion 34 of the cabinet 14. The fan plenum 44 includes a front cover 46 having an edge 48 which is hingedly mounted on the cabinet 14 and a free edge 50 so that the front cover 46 is movable between a closed position and an open position (shown in phantom in FIGS. 2 and 6). The front cover 46 has extending therethrough a fan opening 52 located between the edges 48, 50 so that when the front cover 46 is closed the fan opening 52 communicates with the air flow inlet 36 in the evaporator cover assembly 30. The fan plenum 44 also includes a top cover 54 having a rear edge 56 hingedly mounted on the rear wall of the cabinet 14 adjacent the recirculation inlet 40, and a free edge 58 so that the top cover 54 is also movable between a closed position and an open position (shown in phantom in FIGS. 2 and 6). When the front and top covers 46, 54 are closed, their respective free edges 50, 58 engage and cooperate to close the fan plenum 44.

In order to draw a flow of air from the display portion 32 through the air flow inlet 36 into the lower portion 34 and the fan plenum 44, the freezer 10 also includes a fan 62 mounted on the front cover 46 and in the fan opening 52. The fan 62 draws from the display portion 32 of the cabinet 14 through the air flow inlet 36 into the lower portion 34 of the cabinet 14. The air flows into the fan opening 52 and is forced from the fan plenum 44 in a manner discussed below into the recirculation passage 38 by way of the recirculation inlet 40. The recirculation passage 38 conducts the air flow to the upper portion 32 of the cabinet 14 and discharges the air flow through the recirculation outlet 42.

The freezer 10 also includes an evaporator assembly 64 housed by the fan plenum 44 for cooling the air flowing through the fan plenum 44. As described in detail below, the evaporator assembly 64 and fan plenum 44 cooperate to cool the flow of air drawn through the fan plenum 44 by the fan 62, and to periodically defrost the evaporator assembly 64, in a particularly efficient manner. Also, because of the respective configurations of the evaporator assembly 64 and the fan plenum 44, the volume required of the lower portion 34 of the cabinet 14 to house the fan plenum 44 and evaporator assembly 64 is minimized. In general, the evaporator assembly 64 includes a plurality of tube coils 66 for conducting therethrough a flow of refrigerant, thereby defining a series of refrigerant flow paths or circuits. In the preferred embodiment, selected tube coils 66 are interconnected to provide three independent circuits through which separate refrigerant flows are conducted.

In order to provide the tube coils 66 with refrigerant, the evaporator assembly 64 also includes a refrigerant supply line 74 which is communicable with a compressor (not shown) and which conducts a flow of refrigerant. The supply line 74 enters a divider 78 and splits into three independent inlet lines 82, 86 and 90. Each inlet line 82, 86, 90 conducts a portion of the refrigerant flow into a respective circuit of coil tubes 66.

In this regard, the plurality of coil tubes 66 are interconnected to define the aforementioned circuits 98, 102 and 106. The construction of the circuits is substantially uniform, so only one circuit will be described in detail. The circuits 98, 102 and 106 each include a plurality of generally parallel, elongated tubes 66. While various arrangements for the tubes 66 can be successfully used, in the illustrated embodiment, each tube 66 has a length and opposite ends which, with the exceptions of the inlets and outlets of the respective circuits, are connected by end pieces to an end of an adjacent tube. In the illustrated embodiment, the evaporator assembly 64 includes thirty tubes which are interconnected by end pieces into three circuits having ten tubes each.

Figure 7:
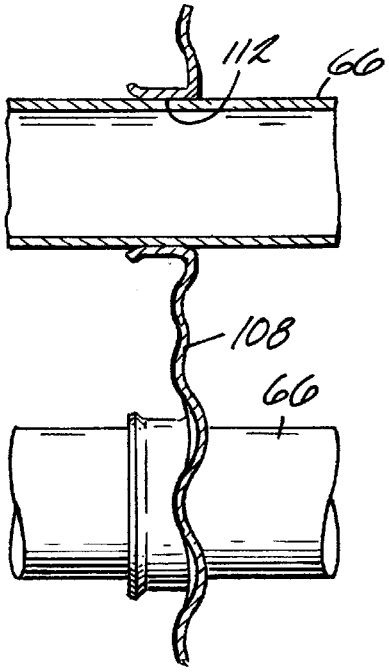
FIG. 7 is a cross-sectional view taken along line 7—7 in FIG. 3.

The tubes 66 are bundled and retained in position by a plurality of thin, sheet-like fins 108. The fins 108 have extending therethrough a series of perforations 112 which receive therethrough a respective tube 66. The perforations 112 are located in the fin 108 to position the tubes 66 in the desired arrangement so that adjacent tubes 66 can be interconnected into the circuits. In order to increase the heat transfer characteristics of the evaporator assembly 64, the fins 108 have (FIG. 7) a wavy, sinusoidal cross-section when viewed in a plane extending parallel to the tubes 66 and perpendicular to the fins 108. This configuration of the fins 108 provides enhanced thermal contact with the air flow across the bundle of tubes 66, producing a relatively small temperature difference between the fin 108 and the air flow.

Each circuit of tubes 66 has one tube end that serves as a refrigerant inlet and another tube end that serves as a refrigerant outlet. The remaining tube ends are interconnected so that the tubes 66 and end pieces of each circuit define an independent flow path extending between the inlet and outlet. Specifically, circuit 98 has an inlet 110 and an outlet 114; circuit 102 has an inlet 118 and an outlet 122; and circuit 106 has inlet 126 and outlet 130.

In the illustrated embodiment, the circuits 98, 102 and 106 are arranged so that the refrigerant inlets 110, 118 and 126 are located at one end of the bundle of tubes 66 adjacent the recirculation passage inlet 40. The inlets 110, 118 and 126 are connected to respective refrigerant inlet lines 82, 86 and 90 so as to receive a flow of refrigerant. In this position, the refrigerant inlets 110, 118 and 126 are located where the air flowing through the fan plenum 44 exits the plenum 44 and enters the recirculation passage 38.

Figure 6:
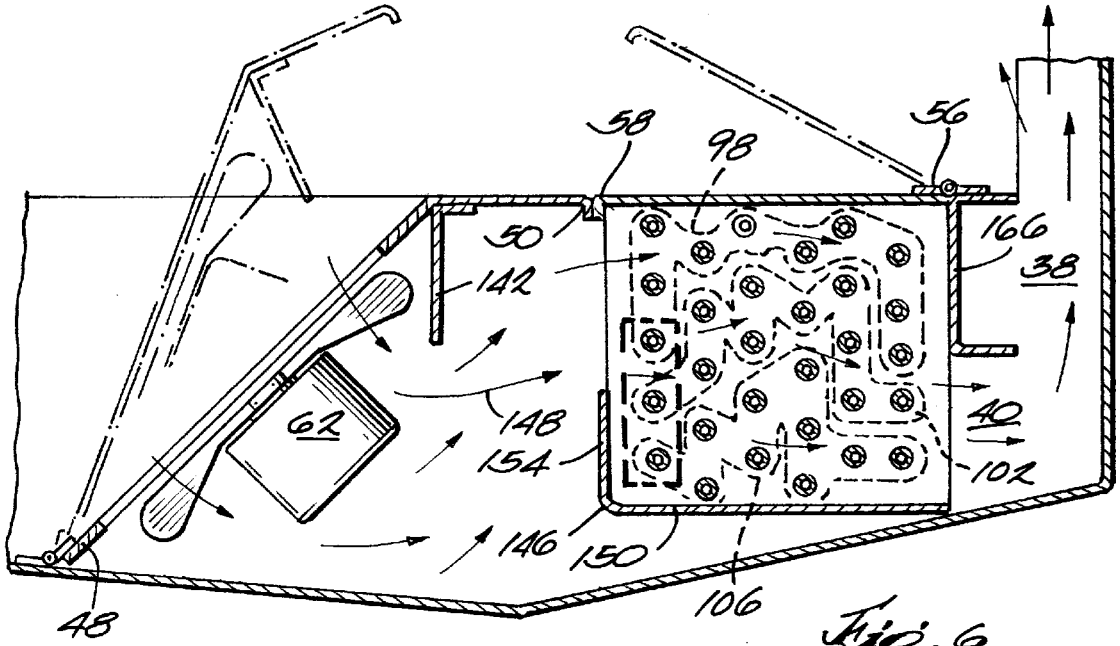
FIG. 6 is a cross-sectional view taken along line 6—6 in FIG. 2.

Similarly, the circuits 98, 102 and 106 are arranged so that the refrigerant outlets 114, 122 and 130 are located at one end of the bundle of tubes 66 upstream of the inlets 110, 118 and 126 with respect to the air flow. The outlets 114, 122 and 130 feed into a collector 134 which, in turn, is connected to a refrigerant return line 138. FIG. 6 includes an outline in phantom showing the paths of the respective circuits 98, 102 and 106 between the inlets 110, 118 126 and respective outlets 114, 122 and 130. As illustrated by FIG. 6, the portions of the circuits 98, 102 and 106 adjacent the outlets 114, 122 and 130, which are the downstream ends of the circuits with respect to the refrigerant flow, are the portions of the evaporator assembly 64 to initially be in heat transfer relation with the air flowing through the fan plenum 44.

In order to direct the air flowing through the plenum 44 across the bundle of tube coils 66 and fins 108, the evaporator assembly 64 also includes a first or front baffle 142 mounted on the front cover 46 of the fan plenum 44. The front baffle 142 is plate-like and extends downwardly from adjacent the fan opening 52 and directs air flowing from the fan opening 52 downwardly. The evaporator assembly 64 also includes a second or lower baffle 146 which cooperates with the front baffle 142 to define a serpentine air flow path 148 extending from the fan opening 52 into the bundle of tubes 66. Specifically, the second baffle 146 includes a first portion 150 underlying the bundle of tubes 66 and extending forward from adjacent the rear wall of the cabinet 14 to a position immediately forward of the tube bundle 66. The second baffle 146 also includes a second plate portion 154 extending upward from the first portion 150 toward the top cover 54 of the fan plenum 44. The plate portion 154 of the second baffle 146 is thus in spaced relation to the first baffle 142 and is parallel to the first baffle 142. The second baffle 146 is thus configured so as to block air flow through the underside of the tube bundle and to direct the air flow passing the first baffle 142 upwardly toward the top of the plenum 44 and past the refrigerant flow circuits. The initial downward direction of the airflow from the fan opening 52 past the first baffle 142, and subsequent upward flow into the tube bundle past the second baffle 146 defines the flow path 148 into a sinuous, curved path, and results in a controlled treatment of the air flowing through the plenum 44. Such controlled air flow tends to minimize complexities and turbulence in the plenum 44 and to assure that the air flowing through the plenum 44 is efficiently conducted into and out of heat transfer relation with the tube bundle 66.

In this regard, the evaporator assembly 64 also includes a third air flow control baffle 166 located immediately downstream, with respect to the air flow, of the tube bundle 66. The third baffle 166 extends downward from the top cover 54 of the fan plenum 44 adjacent the hinged edge 56 to a position adjacent the recirculation passage inlet 40. Thus the third baffle 166 continues the sinuous air flow path 148 defined by the first and second baffles 142, 146 by directing air flow downwardly past the inlet portions of the refrigerant flow circuits and toward the recirculation passage inlet 40.

Preferably, the coil tubes 66 are made of copper and are sized to have a 0.5" outside diameter and are arranged into the three circuits by placing the tubing into an array of runs six rows deep and five tiers high. The provision of one-half inch outer diameter coiling affords the use of a fewer number of coils needed to conduct a sufficient flow of refrigerant. Reducing the counts of coils reduces the number of circuits, and also reduces the volume occupied by the tube bundle.

The fins are preferably made of aluminum sheets having a 6.25 inch by 6.25 inch height and width, and a thickness in the range of 0.0095 inch, and are spaced apart so as to provide four fins per linear inch.

The evaporator assembly is particularly well-suited for use with refrigerants meeting specifications R-404A or R-507, and is optimally operated so as to generate refrigerant velocities in the ranges of $1.0\times10^4$ to $1.5\times10^4$ Btu/hr/in 2. In this regard, the vapor velocities in this range are believed to create a wind chill effect in the tubes so that the refrigerant is in a two-phase state during operation of the evaporator assembly 64.

In operation, the evaporator assembly provides a low-cost, high velocity tube and fin evaporator coil or refrigerant to air heat exchanger for the display freezer 10. The compactness of the evaporator assembly results in a minimum amount of volume needed to house the evaporator, thereby freeing more display volume for the freezer, while maintaining the foot print of the freezer 10.

The sinusoidal air flow path created by the evaporator assembly 64 is also advantageous during defrosting of the evaporator coil by directing and containing the air flow. In particular, the baffles 142, 146 and 166 are located to prevent moist air from billowing through the fan plenum 44 or up the recirculation passage 38.

Various features of the invention are set forth in the following claims.

What is claimed is:

1. A display freezer comprising:

a display case defining an interior space;

an evaporator cover assembly located in the interior space and separating the interior space into a display portion and an evaporator portion;

a fan plenum having therein an inlet communicating with the display portion of the interior space and an outlet spaced from the inlet and communicating between the evaporator portion and the display portion of the interior space;

a fan operable to create a flow of air through the inlet and the outlet;

a first baffle located adjacent the inlet and a second baffle in spaced relation to the first baffle, the first and second baffles defining a serpentine path through which the air flows; and an evaporator coil assembly located in the evaporator portion between the inlet and the outlet, and adjacent to the second baffle, such that the serpentine path extends from approximately the inlet into the evaporator coil assembly, the evaporator coil assembly including a plurality of sheet-like fins extending in the direction of the air flow and having a sinusoidal cross section in a plane perpendicular to the fins, a plurality of evaporator coil circuits extending through the plurality of fins, the evaporator coil circuits being adapted to conduct therethrough a supply of refrigerant.

2. The display freezer of claim 1, wherein the evaporator assembly is below the display portion.

3. The display freezer of claim 1, wherein the first baffle extends downwardly from the evaporator cover assembly to direct air flowing through the inlet in a downwardly direction, and wherein the second baffle includes a first portion underlying the evaporator coil assembly to block air from flowing through an underside of the evaporator coil assembly, and a second portion extending upwardly from the first portion towards the evaporator cover assembly to direct air flowing past the first baffle upwardly toward the evaporator cover assembly and into the evaporator coil assembly.

4. The display freezer of claim 1, wherein the refrigerant flowing through the evaporator coil circuits is R-404A.

5. The display freezer of claim 1, wherein the refrigerant flowing through the evaporator coil circuits is R-507.

6. The display freezer of claim 1, wherein the evaporator coil assembly has a height of approximately 6.25 inches.

7. The display freezer of claim 1, wherein the evaporator assembly includes three evaporator coil circuits.

8. The display freezer of claim 7, further comprising:

a refrigerant inlet communicating with the three evaporator coil circuits; and a divider for dividing the refrigerant into three portions prior to entering the three evaporator coil circuits.

9. The display freezer of claim 1, wherein the evaporator assembly includes a third baffle positioned downstream from the evaporator coil circuits to direct air flowing through the evaporator coil assembly into the outlet.

10. An evaporator assembly comprising:

an inlet and an outlet;

a first baffle, positioned adjacent the inlet;

a second baffle spaced from and in substantially parallel relation with the first baffle, the first baffle and the second baffle defining a serpentine path for conducting a flow of air;

a plurality of sheet-like fins extending in the direction of the air flow and having a sinusoidal cross section in a plane perpendicular to the fins;

a plurality of evaporator coil circuits positioned downstream of the first and second baffles and in the air flow path, the evaporator coil circuits extending through the plurality of fins, the evaporator coil circuits being adapted to conduct therethrough a supply of refrigerant; and a third baffle downstream of the evaporator coil circuits and in the air flow path, such that air flows in a substantially sinusoidal path from the inlet to the outlet.

11. The evaporator assembly of claim 10, further comprising an air flow plenum having a top cover, wherein the first baffle extends downwardly from the top cover to direct air flowing through the inlet in a downwardly direction, and wherein the second baffle includes a first portion underlying the evaporator coil circuits to block air from flowing through an underside of the evaporator coil circuits, and a second portion extending upwardly from the first portion towards the top cover to direct air flowing past the first baffle upwardly toward the top cover and into the evaporator coil circuits, and wherein the third baffle extends downwardly from the top cover to direct air flowing through the evaporator coil circuits into the outlet.

12. The evaporator assembly of claim 10, wherein the refrigerant flowing through the evaporator coil circuits is R-404A.

13. The evaporator assembly of claim 10, wherein the refrigerant flowing through the evaporator coil circuits is R-507.

14. The evaporator assembly of claim 10, wherein the refrigerant flowing through the evaporator coil circuits absorbs heat at a rate of at least 10,000 Btu per hour per square inch of cross-sectional circuit area.

15. The evaporator assembly of claim 10, wherein the evaporator coil assembly has a height of approximately 6.25 inches.

16. The evaporator assembly of claim 10, wherein the plurality of evaporator coil circuits is three evaporator coil circuits.

17. The evaporator assembly of claim 16, wherein the three evaporator coil circuits include respective pluralities of substantially parallel interconnected lengths of tubing.

18. The evaporator assembly of claim 16, wherein the three evaporator coil circuits are arranged in a partially nested configuration.

19. An evaporator assembly comprising:

a first baffle;

a second baffle spaced from the first baffle and, with the first baffle, defining a serpentine path for conducting a flow of air;

a plurality of sheet-like fins extending in the direction of the air flow and having a sinusoidal cross section in a plane perpendicular to the fins;

three evaporator coil circuits extending through the plurality of fins, the three evaporator coil circuits being arranged in a partially nested configuration, and the evaporator coil circuits being adapted to conduct therethrough a supply of refrigerant; and a third baffle downstream of the evaporator coil circuits and in the air flow path.

20. The evaporator assembly of claim 19, wherein the refrigerant flowing through the evaporator coil circuits absorbs heat at a rate of at least 10,000 Btu per hour per square inch of cross-sectional circuit area.

21. The evaporator assembly of claim 19, wherein the refrigerant flowing through the evaporator coil circuits absorbs heat in the range of about 10,000 Btu per hour per square inch of cross-sectional circuit area to about 15,000 Btu per hour per square inch of cross-sectional circuit area.

22. The evaporator assembly of claim 19, wherein each evaporator coil circuit includes a plurality of substantially parallel interconnected lengths of tubing, each of which has a diameter of about 0.5 inches.

23. An evaporator assembly comprising:

a fan plenum having a top portion, an inlet and a spaced apart outlet;

a fan operable to create a flow of air through the inlet and the outlet;

a first cover hingedly mounted to a support surface for movement between a closed position and an open position;

a second cover hingedly mounted to a support surface for movement between a closed position and an open position, such that when the first and second covers are closed, the first and second covers close the top portion of the fan plenum;

a first baffle positioned within the fan plenum;

a second baffle spaced from the first baffle and, with the first baffle, defining a serpentine path for conducting a flow of air within the fan plenum;

a plurality of sheet-like fins extending in the direction of the air flow and having a sinusoidal cross section in a plane perpendicular to the fins;

a plurality of evaporator coil circuits extending through the plurality of fins, the evaporator coil circuits being adapted to conduct therethrough a supply of refrigerant; and a third baffle downstream of the evaporator coil circuits and in the air flow path.

24. The evaporator assembly of claim 23, wherein the fan and the first baffle are mounted to the first cover.

25. A display freezer comprising:

a display case defining an interior space;

an evaporator cover assembly located in the interior space and separating the interior space into a display portion and an evaporator portion;

a fan plenum having therein an inlet communicating with the display portion of the interior space and an outlet spaced from the inlet and communicating between the evaporator portion and the display portion of the interior space;

a fan operable to create a flow of air through the inlet and the outlet; and an evaporator coil assembly located in the evaporator portion between the inlet and the outlet, the evaporator coil assembly including a plurality of asymmetrically configured evaporator coil circuits which are adapted to conduct therethrough a supply of refrigerant, each evaporator coil circuit including a plurality of substantially parallel interconnected lengths of tubing, the evaporator coil circuits being arranged such that a majority of the air entering the evaporator coil assembly first flows past a plurality of tubing of one of the evaporator coil circuits, the plurality of tubing at least partially defining a substantially vertical face of tubing.

26. The display freezer of claim 25, further comprising:

a first baffle located adjacent the inlet, the first baffle extending downwardly from the evaporator cover assembly to direct air flowing through the inlet in a downwardly direction; and a second baffle spaced apart from and in parallel relation to the first baffle, such that the first and second baffles define a serpentine path, the second baffle including a first portion underlying the evaporator coil assembly to block air from flowing through an underside of the evaporator coil assembly, and a second portion extending upwardly from the first portion towards the evaporator cover assembly to direct air flowing past the first baffle upwardly toward the evaporator cover assembly and into the evaporator coil assembly.

27. The display freezer of claim 26, further comprising:

a third baffle positioned downstream from the evaporator coil assembly to direct air flowing through the evaporator coil assembly into the outlet.

28. The display freezer of claim 27, wherein the evaporator assembly includes a top evaporator coil circuit, a middle evaporator coil circuit, and a bottom evaporator coil circuit, and wherein the substantially vertical face of tubing includes a plurality of tubing from the top evaporator circuit.

29. The display freezer of claim 28, wherein the air flows in a substantially sinusoidal flow-pattern from the inlet through the outlet, such that the air flows in a downwardly directed, angular path through the evaporator coil assembly.

30. The display freezer of claim 29, wherein the top evaporator coil circuit includes three lengths of tubing in the substantially vertical face of tubing, and the middle and bottom evaporator coil circuits each include a single length of tubing in the substantially vertical face of tubing.

31. The display freezer of claim 30, wherein each evaporator coil circuit includes ten lengths of tubing.

32. The display freezer of claim 25, further comprising:

a plurality of sheet-like fins through which the evaporator coil circuits extend, the plurality of fins extending in the direction of air flow and having a sinusoidal cross section in a plane perpendicular to the fins.

33. The display freezer of claim 25, further comprising:

a first cover hingedly mounted to a support surface for movement between a closed position and an open position; and a second cover hingedly mounted to a support surface for movement between a closed position and an open position, such that when the first and second covers are closed, the first and second covers close a top portion of the fan plenum.

34. The display freezer of claim 25, wherein the refrigerant flowing through the evaporator coil circuits absorbs heat at a rate of at least 10,000 Btu per hour per square inch of cross-sectional circuit area.

35. The display freezer of claim 25, wherein the refrigerant flowing through the evaporator coil circuits absorbs heat in the range of about 10,000 Btu per hour per square inch of cross-sectional circuit area to about 15,000 Btu per hour per square inch of cross-sectional circuit area.

36. The display freezer of claim 25, wherein each evaporator coil circuit includes a plurality of substantially parallel interconnected lengths of tubing, each of which has a diameter of about 0.5 inches.

37. A method of cooling an interior space of a display freezer, the method comprising the steps of:

providing an evaporator cover assembly to separate the interior space of the display freezer into a display portion and an evaporator portion;

creating a flow of air within the interior space, such that the air circulates from the display portion, through the evaporator portion, and then back into the display portion;

providing an evaporator assembly having a plurality of evaporator coil circuits in the evaporator portion; and conducting a supply of refrigerant through each evaporator coil circuit to cool the air flowing through the evaporator portion, such that the refrigerant flowing through the evaporator coil circuits flows at velocity which is sufficient to create a wind chill effect in the evaporator coil circuits so that the refrigerant is in a two-phase state during operation of the evaporator assembly.

38. The method of claim 37, wherein the refrigerant flowing through the evaporator coil circuits is R-404A.

39. The method of claim 37, wherein the refrigerant flowing though the evaporator coil circuits is R-507.

40. The method of claim 37, wherein the refrigerant flowing through the evaporator coil circuits absorbs heat at a rate of at least approximately 10,000 Btu per hour per square inch of cross-sectional circuit area.

41. The method of claim 37, wherein the refrigerant flowing through the evaporator coil circuits absorbs heat in the range of about 10,000 Btu per hour per square inch of cross-sectional circuit area to about 15,000 Btu per hour per square inch of cross-sectional circuit area.

42. The method of claim 37, wherein each evaporator coil circuit includes a plurality of substantially parallel interconnected lengths of tubing, each of which has a diameter of about 0.5 inches.

* * * * *